US008888537B2

(12) United States Patent
Do

(10) Patent No.: US 8,888,537 B2
(45) Date of Patent: Nov. 18, 2014

(54) AUDIO JACK WITH MULTIPLE POINTS OF CONTACT

(71) Applicant: Apple Computer Inc., Cupertino, CA (US)

(72) Inventor: Trent K. Do, Milpitas, CA (US)

(73) Assignee: Apple Inc., Cupertino, CA (US)

( * ) Notice: Subject to any disclaimer, the term of this patent is extended or adjusted under 35 U.S.C. 154(b) by 42 days.

(21) Appl. No.: 13/678,959

(22) Filed: Nov. 16, 2012

(65) Prior Publication Data

US 2014/0141655 A1 May 22, 2014

(51) Int. Cl.

| | |
|---|---|
| ***H01R 11/22*** | (2006.01) |
| ***H01R 13/52*** | (2006.01) |
| ***H01R 13/506*** | (2006.01) |
| ***H01R 13/187*** | (2006.01) |
| ***H01R 24/58*** | (2011.01) |

(52) U.S. Cl.

CPC ..... *H01R 24/58* (2013.01); *H01R 13/5202* (2013.01); *H01R 13/506* (2013.01); *H01R 13/187* (2013.01)

USPC ..... 439/668; 439/843; 439/851

(58) Field of Classification Search

USPC ..... 439/668, 669, 851, 843

See application file for complete search history.

(56) References Cited

U.S. PATENT DOCUMENTS

| | | | | |
|---|---|---|---|---|
| 4,165,147 | A * | 8/1979 | Buck | 439/188 |
| 5,911,605 | A * | 6/1999 | Wooldridge et al. | 439/790 |
| 6,319,030 | B1 * | 11/2001 | Wu | 439/188 |
| 6,676,451 | B2 * | 1/2004 | Suzuki et al. | 439/668 |
| 7,195,523 | B2 * | 3/2007 | Naviaux | 439/827 |
| 7,828,609 | B2 * | 11/2010 | Li et al. | 439/843 |
| 7,988,498 | B1 * | 8/2011 | Lim et al. | 439/669 |
| 8,118,617 | B2 * | 2/2012 | Jol | 439/668 |
| 8,376,789 | B2 * | 2/2013 | Jol | 439/851 |
| 2003/0077950 | A1 * | 4/2003 | Swearingen et al. | 439/843 |
| 2005/0164566 | A1 * | 7/2005 | Zhao et al. | 439/851 |
| 2006/0014442 | A1 * | 1/2006 | Allgood et al. | 439/843 |
| 2006/0264122 | A1 * | 11/2006 | Aman et al. | 439/843 |
| 2010/0233896 | A1 * | 9/2010 | Dilmaghanian | 439/271 |
| 2012/0315798 | A1 * | 12/2012 | Poon et al. | 439/668 |

* cited by examiner

*Primary Examiner* — Gary Paumen

(74) *Attorney, Agent, or Firm* — Kilpatrick Townsend & Stockton LLP

(57) ABSTRACT

An improved electronic audio receptacle connector employs contacts that have multiple points of contact with a mating audio plug. The contacts each have multiple segments, each segment having a plurality of transverse fingers that interface with a conductive portion of the audio plug. The multiple points of contact improve the reliability of the receptacle connector. The housing of the receptacle connector may be made of two portions mated along an interface. The two portions may have features along the interface to impede moisture ingression and to interlock them together.

28 Claims, 9 Drawing Sheets

AUDIO JACK WITH MULTIPLE POINTS OF CONTACT

BACKGROUND OF THE INVENTION

The present invention relates generally to electrical audio connectors and in particular to electrical audio connectors that can be mounted to a substrate, such as a printed circuit board (PCB), within an electronic device. A wide variety of electronic devices are available for consumers today that use a wide variety of connectors to facilitate communication with other devices and/or accessories.

As an example, audio jack receptacle connectors are sometimes positioned at one or more of the external surfaces of an electronic device and mounted to a PCB within the device. As smart-phones, media players, charging stations and other electronic devices become more indispensable to their operators, the devices are with their operators more frequently and are more likely to be exposed to harsh environments that may damage the connectors and/or the device. For example, audio plug connectors are often unplugged from the electronic device and may be physically damaged or contaminated with non-conductive debris. Further, the electronic device itself may be exposed to liquid which may enter the device through the connector opening. Either of these scenarios may result in a failure of the electronic device to operate properly.

BRIEF SUMMARY OF THE INVENTION

Embodiments of the invention pertain to receptacle connectors, such as audio receptacle connectors, used in a variety of electronic devices. Some embodiments of the invention provide a contact system that has multiple contact points for redundancy and that assists with balancing forces during a mating event. Other embodiments of the invention use overmolding or other injection molding techniques to improve the water proofing characteristics of an audio jack receptacle connector or other type of connector. Still other embodiments include multiple contact points and improved water proofing characteristics.

Contacts within the connector may provide contact points at multiple locations around a circumference of a plug connector. In some embodiments the locations are spaced evenly apart in one or more 90 degree segments along the entire 360 degree circumference of the plug. In some embodiments the internal portion of the contact may have four segments arranged in a square pattern covering the 360 degree circumference of the plug. In other embodiments the internal portion of the contact may have only one segment covering a 90 degree portion of the circumference of the plug. In further embodiments the contact may have one segment arranged in a circle covering the entire 360 degree circumference of the plug. In still further embodiments, one or more segments may have an outside portion positioned external to the connector housing for connecting the contact to a PCB or other structure.

In some embodiments, each contact segment may comprise a pair of parallel longitudinal rails having a plurality of transverse fingers disposed between the pair of rails and attached to the pair of parallel longitudinal rails. The fingers may be arranged to interfere with a conductive portion of the plug portion of mating audio plug. More specifically, a single contact may comprise a plurality of fingers, all of which may contact a single conductive portion of the plug, providing redundant contacts.

Some embodiments of the housing of the receptacle connector may be made from a base portion and a lid portion that are joined along an interface. In some embodiments, the housing may have features such as tabs on the lid and corresponding tab recesses on the base portion that help hold the housing together. In further embodiments, the housing may have features along the interface that make the housing impervious to liquid. One embodiment comprises a base portion with a slot along the interface and a lid portion with a rail along the interface, wherein the rail is engaged in the slot along the interface.

To better understand the nature and advantages of the present invention, reference should be made to the following description and the accompanying figures. It is to be understood, however, that each of the figures is provided for the purpose of illustration only and is not intended as a definition of the limits of the scope of the present invention.

DETAILED DESCRIPTION OF THE INVENTION

Certain embodiments of the present invention relate to electrical connectors assembled to PCBs that may be employed in electronic devices. While the present invention can be useful to produce connector assemblies for a wide variety of electronic devices, some embodiments of the invention are particularly useful for producing audio connector assemblies for electronic devices that require improved reliability, as described in more detail below.

Embodiments of the present invention may include a receptacle connector for receiving an audio connector or plug, e.g., a standard audio connector or plug. Standard audio plugs are available in three sizes according to the outside diameter of the plug: a 6.35 mm (¼") plug, a 3.5 mm (⅛") miniature plug and a 2.5 mm (3/32") subminiature plug. The plugs include multiple conductive regions that extend along the length of the connectors in distinct portions of the plug such as the tip, sleeve and one or more middle portions or "rings" located between the tip and sleeve, resulting in the connectors often being referred to as TRS (tip, ring and sleeve) connectors.

Figure 1A:
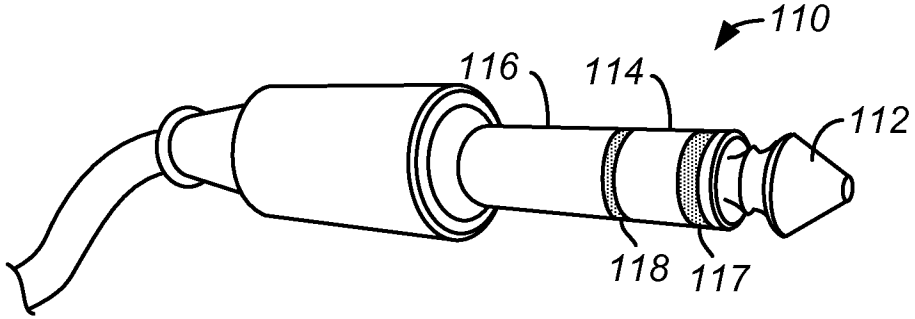
FIG. 1A is a diagram that illustrates an example of an audio plug.
Figure 1B:
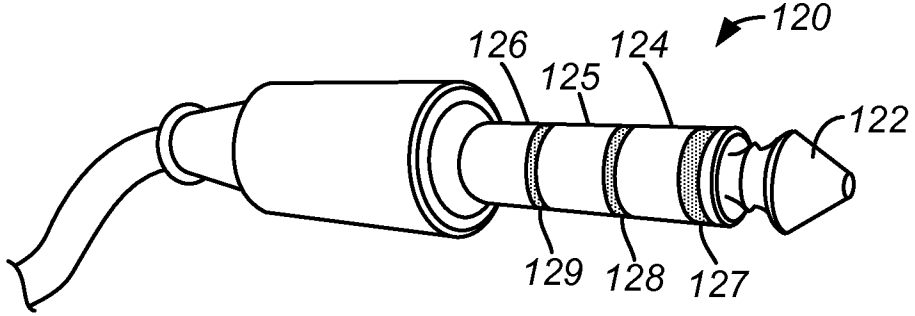
FIG. 1B is a diagram that illustrates an example of an audio plug.

FIGS. 1A and 1B illustrate examples of audio plugs 110 and 120 having three and four conductive portions, respectively. As shown in FIG. 1A, plug 110 includes a conductive tip 112, a conductive sleeve 116 and a conductive ring 114 electrically isolated from the tip 112 and the sleeve 116 by insulating rings 117 and 118. The three conductive portions 112, 114, 116 are for left and right audio channels and a ground connection, respectively. Plug 120, shown in FIG. 1B, includes four conductive portions: a conductive tip 122, a conductive sleeve 126 and two conductive rings 124, 125 and is thus sometime referred to as a TRRS (tip, ring, ring, sleeve) connector. The four conductive portions 122, 124, 125 and 126 are electrically isolated by insulating rings 127, 128 and 129 and are typically used for left and right audio, ground and microphone signals, respectively.

When plugs 110 and 120 are 3.5 mm miniature connectors, the outer diameter of conductive sleeve 116, 126 and conductive rings 114, 124, 125 is 3.5 mm and the insertion length of the connector is 14 mm. For 2.5 mm subminiature connectors, the outer diameter of the conductive sleeves is 2.5 mm and the insertion length of the connector is 11 mm long. Such TRS and TRRS connectors are used in many commercially available MP3 players and smart phones as well as other electronic devices.

Plugs 110 and 120 may interface with a receptacle connector mounted in an electronic device. The contacts are one of the most critical components of the connectors. The contacts are the portions of the receptacle connector and the plug that physically touch when the connectors are engaged and are responsible for conducting the electrical signals between the mated connectors. Not only must these contacts survive sometimes thousands of mates and de-mates, they must also withstand the rigors of today's consumer, remaining with them throughout the day as they travel in and out of fitness centers, kitchens, offices, factories, automobiles, and many other places. Many of these locations provide opportunities for exposure to chemicals or connector damage that pose little or no risk to the consumer, but present a harsh environment for the contacts. For example, connectors regularly come into contact with food, sweat, and other elements that may corrode or contaminate the materials that make up the connector contacts. In addition, electronic devices may be exposed to liquids such as a bathtub or rain, which may penetrate the device and destroy it.

To further illustrate embodiments of the invention, various examples of electrical audio connectors that include improved reliability and/or improved resistance to liquid ingression that may be made in accordance with the present invention are discussed below; however these embodiments should in no way limit the applicability of the invention to other connectors.

Figure 2:
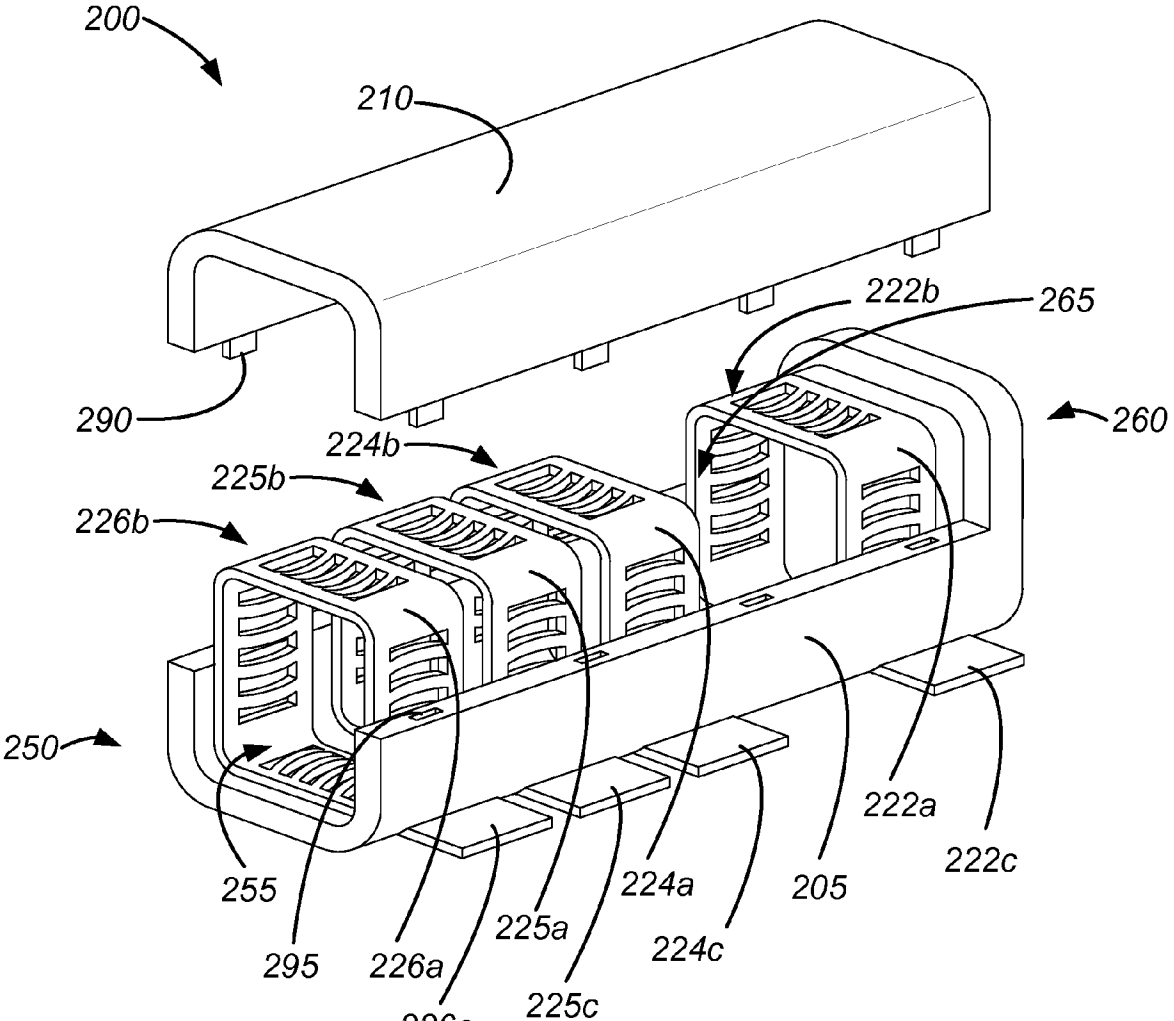
FIG. 2 is a diagram that illustrates an exploded front perspective view of an electrical audio receptacle connector with contacts comprising multiple points of contact in accordance with an embodiment of the invention.

FIG. 2 is a simplified exploded perspective view of an audio receptacle connector 200, in accordance with one embodiment of the invention. Receptacle connector 200 may include a body having an opening 255 that communicates with a cavity 265 having height, width and depth dimensions. Receptacle connector 200 may have a receiving face 250 with front opening 255 to receive a plug portion of a mating audio plug connector 120 (see FIG. 1B) and rear face 260 disposed opposite of the receiving face. Housing 205, 210 may extend between receiving face 250 and rear face 260 and define a cavity 265 that communicates with front opening 255. A plurality of contacts 222*a*, 224*a*, 225*a*, 226*a*, may be positioned within and spaced apart along a depth of the cavity and each may have an internal portion 222*b*, 224*b*, 225*b*, 226*b* disposed within cavity 265 and external portions 222*c*, 224*c*, 225*c*, 226*c* disposed outside of housing 205, 210. External portions 222*c*, 224*c*, 225*c*, 226*c* may be configured to mount receptacle connector 200 to a printed circuit board or similar structure and provide an electrical path from contacts 222*a*, 224*a*, 225*a*, 226*a* to the electronic device.

In some embodiments, housing 205, 210 may comprise two pieces, including a base portion 205 and a lid portion 210. In further embodiments, base portion 205 may be formed separately and contacts 222*a*, 224*a*, 225*a*, 226*a* may be subsequently inserted into the base portion. In other embodiments, base portion 205 may be formed around the contacts using, for example, an insert-molding process. In one embodiment an insert-molding process comprises placing the contacts in a portion of a molding die, closing the die, and injecting molten polymer around at least a portion of the contacts. In some embodiments, lid portion 210 may be formed separately using, for example, an injection molding process, while in other embodiments the lid portion may be formed around contacts 222*a*, 224*a*, 225*a*, 226*a* using, for example, an insert-molding process. In one embodiment an injection molding process comprises forming a cavity in a die, injecting molten polymer into the cavity, and removing the formed component from the die. In further embodiments, housing 205, 210 may be one piece and formed, for example, by insert-molding around contacts 222*a*, 224*a*, 225*a*, 226*a*. In yet further embodiments, receiving face 250 of housing 205, 210 may have a face plate or bezel configured to engage with and form a liquid-tight seal to the electronic device.

In embodiments where base portion 205 is separate from lid portion 210, the lid portion may be equipped with one or more tabs 290, and base portion may be equipped with one or more tab recesses 295 where the tabs and tab recesses are configured to align and/or interlock the components together. In further embodiments, where lid portion 210 may be molded separately and pressed into place, tabs 290 and tab recesses 295 may be, for example, a clearance fit, an interference fit or snap-fit. Other embodiments may use different interlock features, such as, for example, pins and holes, latch features or adhesive. Interlock features may also be used in embodiments where lid portion 210 is insert-molded onto base portion 205. In these embodiments, during the molding of lid portion 210, molten plastic may flow into tab recesses 295 in base portion 205, and serve as an interlock between the two components.

Figure 3A:
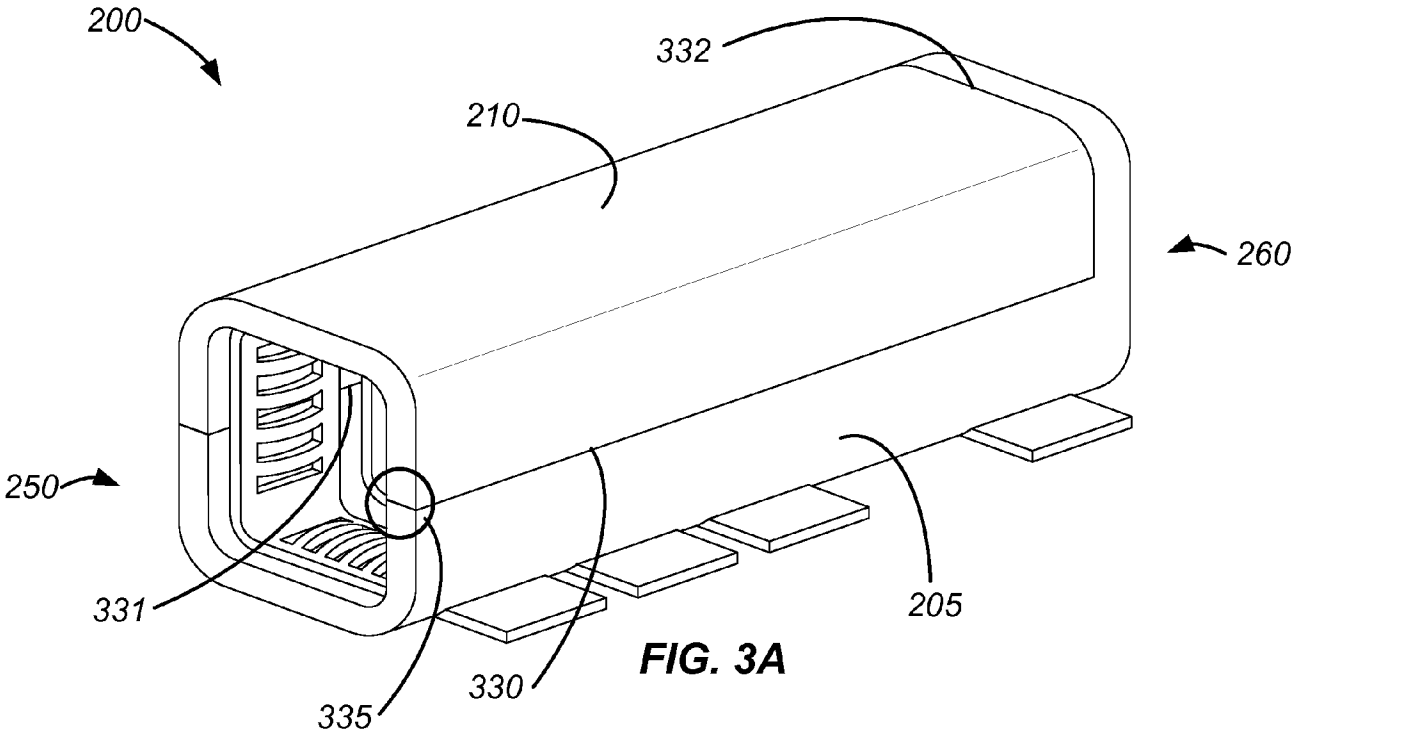
FIG. 3A is a diagram that illustrates a front perspective view of an electrical audio receptacle connector with contacts comprising multiple points of contact in accordance with an embodiment of the invention.
Figure 3B:
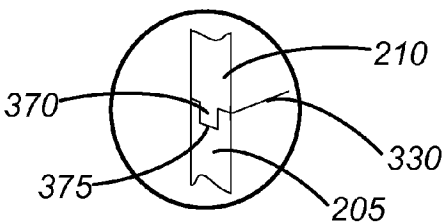
FIG. 3B is a diagram of an embodiment that illustrates a housing interface feature in accordance with an embodiment of the invention.
Figure 3C:
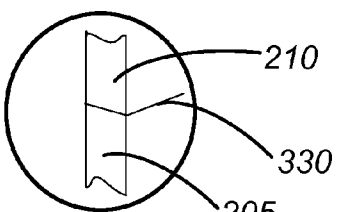
FIG. 3C is a diagram of an embodiment that illustrates a housing interface feature in accordance with an embodiment of the invention.
Figure 3D:
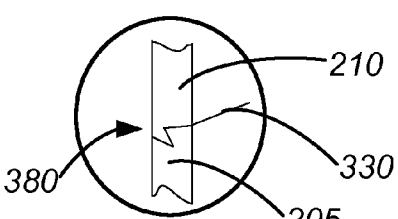
FIG. 3D is a diagram of an embodiment that illustrates a housing interface feature in accordance with an embodiment of the invention.

Some embodiments may benefit from receptacle connector 200 inhibiting liquid ingression into the electronic device through the connector. The housing configurations discussed above may be employed in some embodiments to make a liquid-tight connector that may have a tube like structure with a lid portion 210 and a base portion 205 having a plurality of contacts that extend through the base. The tube like structure may have a first interface 330 running the length of one side, a second interface 331 running the length of a second side, and a third interface 332 between the first and second interfaces. The interfaces may be configured to be substantially liquid-tight. FIG. 3A shows the housing fully assembled with base portion 205 of the housing aligned and mated to lid portion 210 along interfaces 330, 331, 332. In some embodiments, insert-molding lid portion 210 onto base portion 205 may adhere the two components together along interfaces 330, 331, 332 which may form a liquid-tight connector 200. Other embodiments may use different interface designs to form a liquid-tight connector. For example, FIG. 3B shows an enlarged view of one embodiment of interface 330, 331, 332 taken in region 335 where lid portion 210 may be glued and adhered to base portion 205. FIG. 3C illustrates an embodiment having a rail 370 disposed on lid portion 210 and slot 375 disposed on base portion 205. FIG. 3D illustrates a further embodiment having a half dove tail feature 380 employed along interface 330, 331, 332. Interface features illustrated in FIGS. 3C and 3D may be called interlocking geometry and they may be disposed along the entire interface 330, 331, 332 or only a portion thereof. Myriad designs can be employed along interface 330, 331, 332 to form a liquid-tight receptacle connector. For example, further embodiments may use an externally applied sealant or tape along interface 330, 331, 332.

In some embodiments a liquid tight seal may be formed at an interface between each contact external portion 222*c*, 224*c*, 225*c*, 226*c* and the body. In further embodiments, this may be accomplished by insert-molding contacts 222*a*, 224*a*, 225*a*, 226*a* into base portion 205 of housing. In other embodiments, this may be performed by adding a sealant or epoxy to the interface of base portion 205 of housing and external portion 222*c*, 224*c*, 225*c*, 226*c* of contacts. In further embodiments, a liquid tight seal may be formed by employing an interference fit between base portion 205 of housing and external portion 222*c*, 224*c*, 225*c*, 226*c* of contacts. Myriad methods can be used to form a liquid tight seal between base portion 205 of housing and external portion 222*c*, 224*c*, 225*c*, 226*c* of contacts.

Figure 4:
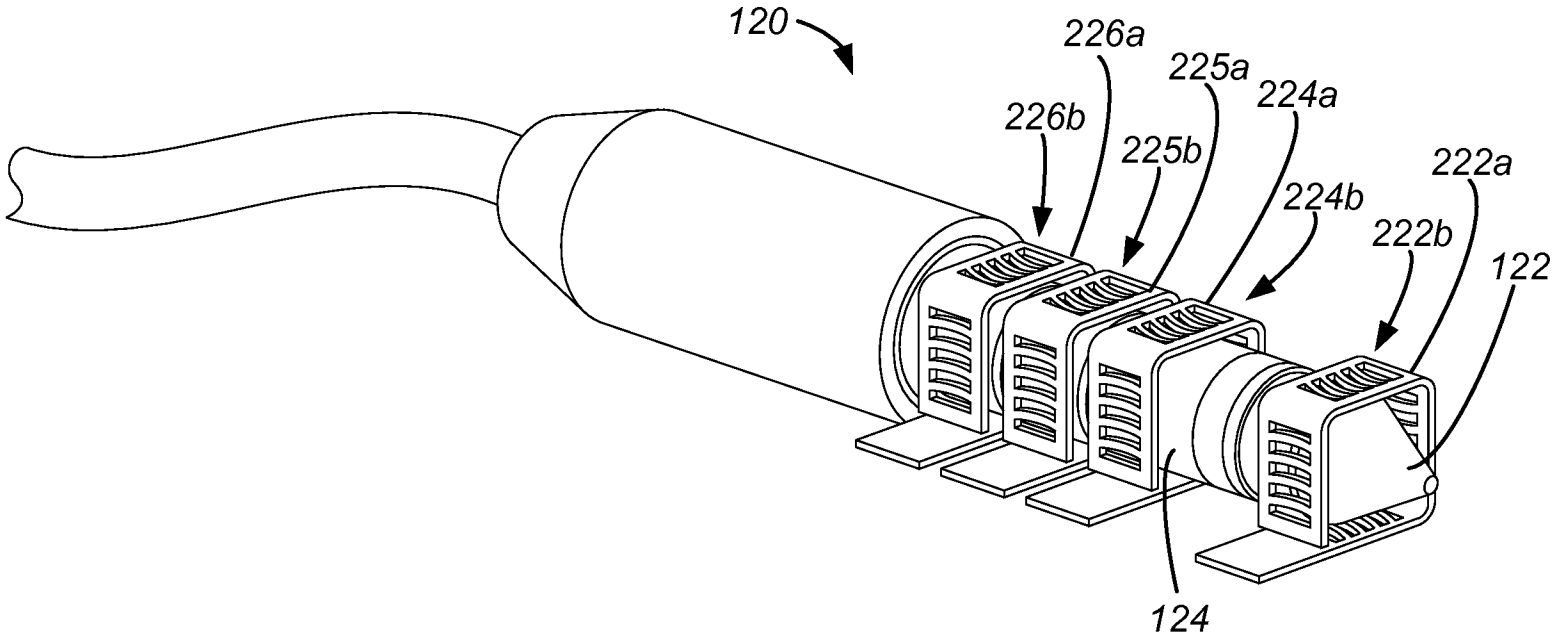
FIG. 4 is a diagram that illustrates a perspective view of an audio plug engaged with an electrical audio receptacle connector with the connector housing removed in accordance with an embodiment of the invention.

FIG. 4 illustrates one embodiment of receptacle connector 200 (see FIG. 2) engaged with example plug 120. In this illustration, lid portion 210 (see FIG. 2) and base portion 205 of housing have been removed for clarity, and example plug 120 is shown engaged with contacts 222*a*, 224*a*, 225*a*, 226*a*. Each contact 222*a*, 224*a*, 225*a*, 226*a* may be aligned with a conductive portion of plug 120. For example, in one embodiment, first contact 222*a* may be aligned with conductive tip 122 to conduct left audio signals, second contact 224*a* may be aligned with conductive ring 124 to conduct right audio signals, third contact 225*a* may be aligned with conductive ring 125 (see FIG. 1B) to conduct ground signals, and fourth contact 226*a* may be aligned with conductive sleeve 126 to conduct microphone signals. While the invention has been described with respect to jacks for standard TRRS audio connectors, it can be used with other types of connectors.

Figures 5, 6, 7:
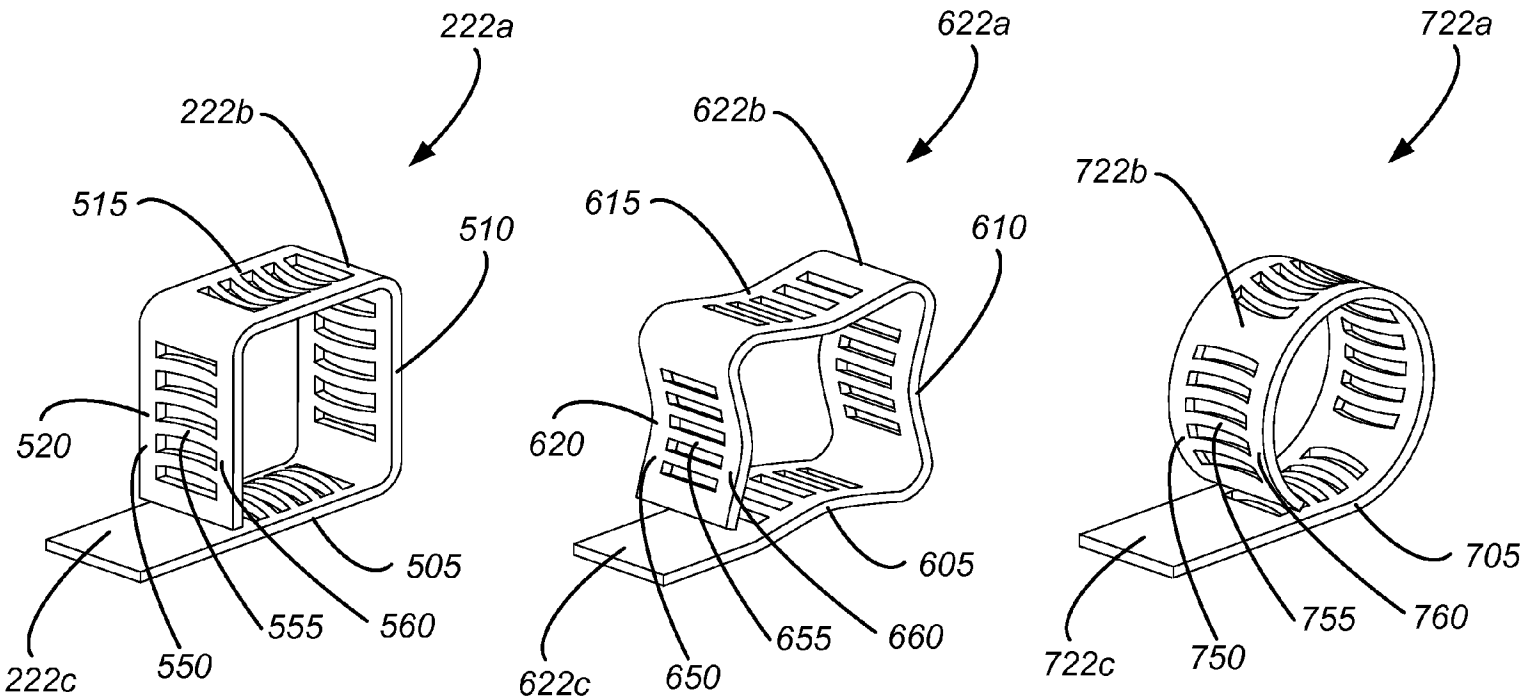
FIG. 5 is a diagram that illustrates a perspective view of a contact in accordance with an embodiment of the invention.
FIG. 6 is a diagram that illustrates a perspective view of a contact in accordance with an embodiment of the invention.
FIG. 7 is a diagram that illustrates a perspective view of a contact in accordance with an embodiment of the invention.

As illustrated in FIG. 5, contact 222*a* has been removed from receptacle connector 200 (see FIG. 2) and will be used to show features that may be applicable to any of contacts 222*a*, 224*a*, 225*a* or 226*a*. Contact 222*a* may have internal portion 222*b* that may comprise multiple primary contact segments 505, 510, 515, 520. For example, internal portion 222*b* of contact 222*a* may have first segment 505 that may be substantially straight and second segment 510 that may be also substantially straight and may be connected to the first segment at an angle of approximately 90 degrees. Contact 222*a* may further have third segment 515 that may be substantially straight and may be connected to second segment 505 at an angle of approximately 90 degrees. Contact 222*a* may further have fourth segment 520 that may be substantially straight and may be connected to third segment 515 at an angle of approximately 90 degrees. The four segments 505, 510, 515, 520 of internal portion 222*b* of contact 222*a* may form a substantially square cross-sectional shape such that when combined, they form an aperture through which audio plug connector 120 (see FIG. 1B) can be inserted. Each contact 222*a* may have first and second opposing contact surfaces and third and fourth opposing contact surfaces. The first and second opposing surfaces may extend in the height dimension on opposite sides of cavity 265 (see FIG. 2) and the third and fourth opposing surfaces may extend in the width dimension on opposite sides of the cavity. The end of segment 520 may be attached to segment 505, or base portion 205 (see FIG. 2) of housing may hold segment 520 in place. First segment 505 of contact 222*a* may have outside portion 222*c*, sometimes called a lead, that may be disposed outside of housing 205, 210 (see FIG. 2) and used to electrically couple the contact to a printed circuit board or other structure.

Further, each segment 505, 510, 515, 520 of contact 222*a* may comprise a pair of parallel longitudinal rails 550, 560 having a plurality of transverse fingers 555 disposed between the pair of rails and attached to the pair of parallel longitudinal rails. Fingers 555 may be arranged to interfere with conductive portions 126, 125, 124, 122 (see FIG. 1B) of the plug portion of mating audio plug 120. More specifically, a single contact 222*a* may each comprise a plurality of fingers 555, all of which may contact a single conductive portion of plug 120 (see FIG. 1B). When plug 120 (see FIG. 1B) is engaged with contact 222*a*, one or more portions of contact may deflect to accommodate the generally larger geometry of the plug. In some embodiments one or more transverse fingers 555 may deflect. In another embodiment, one or more longitudinal rails 550, 560 may deflect. In other embodiments, one or more segments 505, 510, 515, 520 may deflect. In further embodiments any combination of the above may deflect to accommodate plug 120 (see FIG. 1B).

Some contacts in some embodiments may be considered to have two levels of redundancy. First, each segment 505, 510, 515, 520 may have a plurality of fingers 555 that may act as a redundant electrical connection between contact 222*a* and the respective single conductive portion of plug 120 (see FIG. 1B). Second, each contact may have more than one segment disposed around the circumference of plug 120 (see FIG. 1B), where each segment may act as a redundant electrical connection between contact 222*a* and the respective single conductive portion of the plug. For example, contact 222*a* illustrates four fingers 555 disposed on each of the four segments 505, 510, 515, 520 of the contact. This may result in sixteen separate contacts with conductive tip 122 of plug 120 (see FIG. 4). Some embodiments may have both levels of redundancy (e.g., FIGS. 5-7) while other embodiments may have just one level of redundancy (e.g. FIG. 8). Contact 222*a* in FIG. 5 has four segments at 90 degree intervals, each of which may have multiple individual contact points.

In some embodiments, redundant electrical connections may improve the reliability and/or performance of receptacle connector 200 (see FIG. 2). For example, if a portion of conductive tip 122 (see FIG. 2) of plug 120 is damaged or contaminated with a non-electrically conductive substance, the plurality of fingers 555 increases the likelihood that at least one of the fingers will make electrical contact with the conductive tip of the plug. Fingers 555 may be generally flat, or arcuate wherein they may be curved inward towards a line that longitudinally bisects the center of cavity 265 (see FIG. 2).

Further, each of contacts 222*a*, 224*a*, 225*a*, 226*a* may be designed to be wiping contacts that, during every mate and de-mate cycle, the contact of either the plug or the receptacle is forcibly pushed against the opposing contact during insertion and withdrawal of the plug. This results in a wiping action that helps breaks through any nonconductive surface corrosion and oxidation on the contact surface helping retain intimate metal-to-metal contact between the plug contacts and the receptacle contacts.

Other embodiments, as illustrated in FIG. 6, may have contacts 622*a* with internal portion 622*b* comprising segments 605, 610, 615, 620. Each segment may have a pair of parallel longitudinal rails 650, 660 and a plurality of transverse fingers 655 disposed between the pair of rails and attached to the pair of parallel longitudinal rails. Longitudinal rails 650, 660 may be somewhat arcuate, or non-linear in shape. Fingers 655 may be arranged to interfere with conductive portions 126, 125, 124, 122 (see FIG. 1B) of the plug portion of mating audio plug 120. Fingers 655 may be generally flat, or arcuate wherein they may be curved inward towards a line that longitudinally bisects the center of cavity 265 (see FIG. 2). The end of segment 620 may be attached to segment 605, or base portion 205 (see FIG. 3A) of housing may hold segment 620 in place. One segment 605 of contact 622*a* may have outside portion 622*c* that may be used to electrically couple the contact to a printed circuit board or other structure.

Other embodiments, as illustrated in FIG. 7, may have contacts 722*a* with internal portion 722*b* comprising a single segment 705 formed in a generally circular shape. Segment 705 may comprise a pair of parallel longitudinal rails 750, 760 having a plurality of transverse fingers 755 disposed between the pair of rails and attached to the pair of parallel longitudinal rails. Longitudinal rails 750, 760 may be somewhat arcuate in shape, forming the generally circular cross-sectional shape of contact 722*a*. Fingers 755 may be arranged to interfere with conductive portions 126, 125, 124, 122 (see FIG. 1B) of the plug portion of mating audio plug 120. Fingers 755 may be generally flat, or arcuate wherein they may be curved inward towards a line that longitudinally bisects the center of cavity 265 (see FIG. 2). The end of segment 705 may be attached to the beginning of segment 705, or the base portion 205 (see FIG. 3A) of housing may hold the end of segment 705 in place. Segment 705 of contact 722*a* may have outside portion 722*c* that may be used to electrically couple the contact to a printed circuit board or other structure. Contacts 222*a*, 622*a* and 722*a* are for illustrative purposes only and other contact shapes and geometries may be employed in further embodiments. For example, further embodiments may have other designs such as, hexagonal, octagonal, triangular or oval shapes comprising one or more segments.

Figure 8:
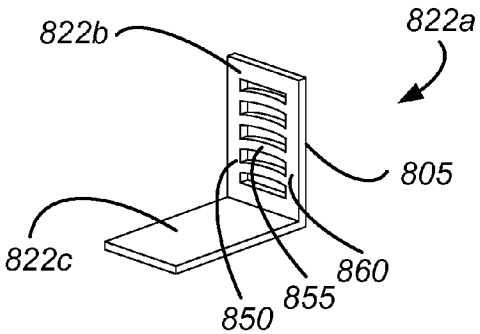
FIG. 8 is a diagram that illustrates a perspective view of a contact in accordance with an embodiment of the invention.

Other embodiments, as illustrated in FIG. 8, may have contacts 822*a* with internal portion 822*b* comprising a single segment 805 formed in a generally straight shape. Segment 805 may comprise a pair of parallel longitudinal rails 850, 860 having a plurality of transverse fingers 855 disposed between the pair of rails and attached to the pair of parallel longitudinal rails. Longitudinal rails 850, 860 may be substantially straight. Fingers 855 may be arranged to interfere with conductive portions 126, 125, 124, 122 (see FIG. 1B) of the plug portion of mating audio plug 120. Fingers 855 may be generally flat, or arcuate wherein they may be curved inward towards a line that longitudinally bisects the center of cavity 265 (see FIG. 2). The base portion 205 (see FIG. 3A) of housing may hold segment 805 in place. Segment 805 of contact 822*a* may have an outside portion 822*c* that may be used to electrically couple the contact to a printed circuit board or other structure.

Figure 9:
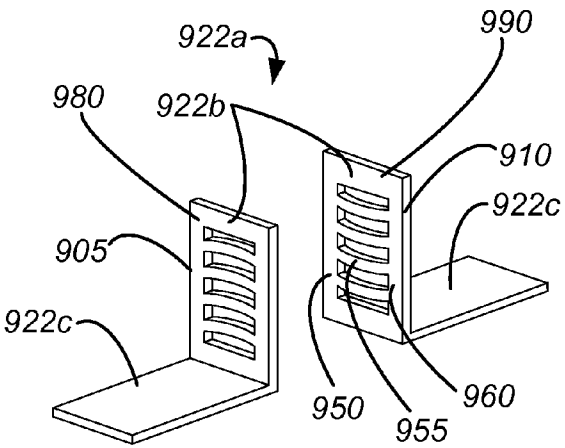
FIG. 9 is a diagram that illustrates a perspective view of a contact in accordance with an embodiment of the invention.

Further embodiments, as illustrated in FIG. 9, may have contacts 922*a* with two halves 980, 990, each similar to contact 822*a* in FIG. 8. Each half, 980, 990 may have an internal portion 922*b* comprising a single segment 905, 910 respectively, formed in a generally straight shape. Segments 905, 910 may each comprise a pair of parallel longitudinal rails 950, 960 having a plurality of transverse fingers 955 disposed between the pair of rails and attached to the pair of parallel longitudinal rails. Longitudinal rails 950, 960 may be substantially straight. Fingers 955 may be arranged to interfere with conductive portions 126, 125, 124, 122 (see FIG. 1B) of the plug portion of mating audio plug 120. Fingers 955 may be generally flat, or arcuate wherein they may be curved inward towards a line that longitudinally bisects the center of cavity 265 (see FIG. 2). The base portion 205 (see FIG. 3A) of housing may hold segments 905, 910 in place. Segments 905, 910 of contact 922*a* may have outside portions 922*c* that may be used to electrically couple the contact to a printed circuit board or other structure.

Figure 10:
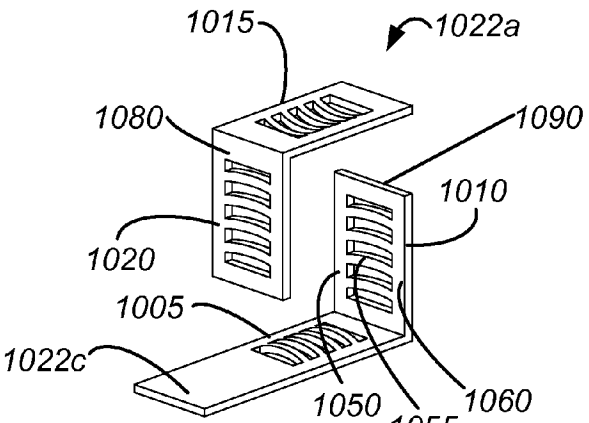
FIG. 10 is a diagram that illustrates a perspective view of a contact in accordance with an embodiment of the invention.

Still further embodiments, as illustrated in FIG. 10, may have contacts 1022*a* comprising two components 1080, 1090. In some embodiments, the two components 1080, 1090 may be formed, joined and subsequently installed in base portion 205 (see FIG. 3A) of housing. In other embodiments, component 1090 may be installed in base portion 205 (see FIG. 3A) of housing, then the second component 1080 may be joined to the first 1090. The lid portion 210 (see FIG. 3A) of housing may then be subsequently assembled. In other embodiments, base portion 205 of housing may be insert-molded around component 1090 and component 1080 may be subsequently joined to component 1090. Joining may be performed, for example, by welding, soldering or using a conductive adhesive. Once the two components 1080, 1090 are joined, contact 1022*a* may resemble contact 222*a* and perform similarly. Thus, when fully assembled, contact 1022*a* may have four segments, where each segment 1005, 1010, 1015, 1020 of contact 1022*a* may comprise a pair of parallel longitudinal rails 1050, 1060 having a plurality of transverse fingers 1055 disposed between the pair of rails and attached to the pair of parallel longitudinal rails. Fingers 1055 may be arranged to interfere with conductive portions 126, 125, 124, 122 (see FIG. 1B) of the plug portion of mating audio plug 120. Fingers 1055 may be generally flat, or arcuate wherein they may be curved inward towards a line that longitudinally bisects the center of cavity 265 (see FIG. 2). The base portion 205 (see FIG. 3A) of housing may hold segments 1005, 1010, 1015, 1020 in place. Segment 1005 of contact 1022*a* may have outside portion 1022*c* that may be used to electrically couple the contact to a printed circuit board or other structure.

Figure 11:
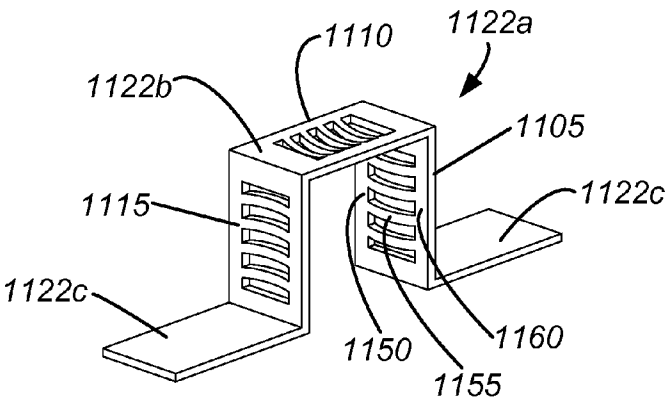
FIG. 11 is a diagram that illustrates a perspective view of a contact in accordance with an embodiment of the invention.

Other embodiments, as illustrated in FIG. 11, may have contacts 1122*a* with internal portion 1122*b* comprising segments 1105, 1110, 1115. Each segment may have a pair of parallel longitudinal rails 1150, 1160 and a plurality of transverse fingers 1155 disposed between the pair of rails and attached to the pair of parallel longitudinal rails. Fingers 1155 may be arranged to interfere with conductive portions 126, 125, 124, 122 (see FIG. 1B) of the plug portion of mating audio plug 120. Fingers 1155 may be generally flat, or arcuate wherein they may be curved inward towards a line that longitudinally bisects the center of cavity 265 (see FIG. 2). Segments 1105, 1115 of contact 1122*a* may have outside portions 1122*c* that may be used to electrically couple the contact to a printed circuit board or other structure. Contacts 822*a*, 922*a*, 1022*a* and 1122*a* are for illustrative purposes only and other contact shapes and geometries may be employed in further embodiments.

Figure 13:
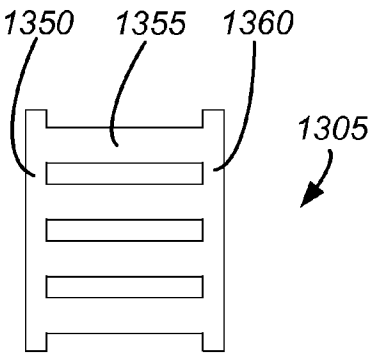
FIG. 13 is a diagram that illustrates a plan view of a contact segment in accordance with an embodiment of the invention.

Referring back to FIG. 5, the internal portion 222*b* of contact 222*a* may be comprised of segments 505, 510, 515, 520. Segments 505, 510, 515, 520 may be of myriad designs. In one embodiment, illustrated in FIG. 12, segment 1205 may comprise a pair of parallel longitudinal rails 1250, 1260 having a plurality of transverse fingers 1255 disposed between the pair of rails and attached to the pair of parallel longitudinal rails. In this embodiment, the width of the transverse rails 1255 may be slightly less than the width of the longitudinal rails 1250, 1260. Comparatively, in FIG. 13, the width of transverse rails 1355 of segment 1305 are somewhat wider than that of the longitudinal rails 1350, 1360. Thus the deflection of segment 1205 when engaged with plug 120 (see FIG. 1B) may be different than the deflection of segment 1305. The width of both the longitudinal and the transverse rails may be varied to change the performance of the contact. For example, the narrow transverse rails of segment 1205 may allow each rail to deflect easier, applying a lower normal force on the plug contact, whereas the wider rails of segment 1305 may apply a higher normal force on the plug contact.

Figure 14:
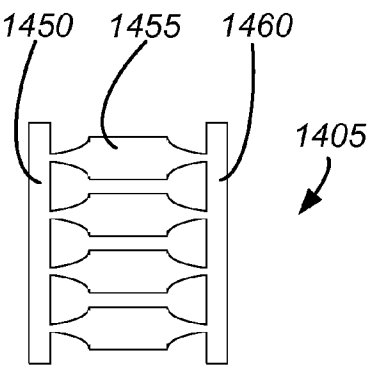
FIG. 14 is a diagram that illustrates a plan view of a contact segment in accordance with an embodiment of the invention.
Figure 17:
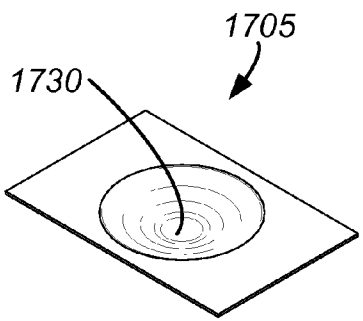
FIG. 17 is a diagram that illustrates a perspective view of a contact segment in accordance with an embodiment of the invention.
Figure 16:
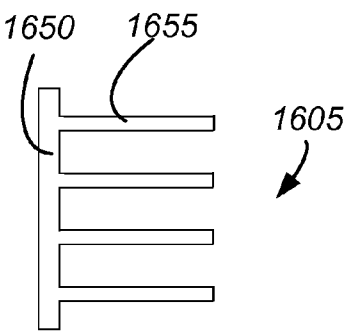
FIG. 16 is a diagram that illustrates a plan view of a contact segment in accordance with an embodiment of the invention.
Figure 15:
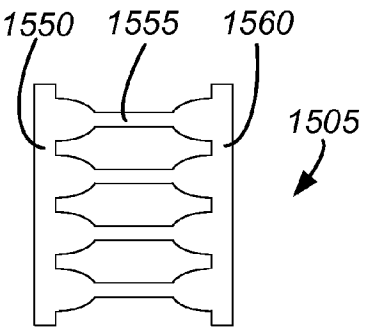
FIG. 15 is a diagram that illustrates a plan view of a contact segment in accordance with an embodiment of the invention.

Further embodiments, as illustrated in FIGS. 14 and 15, may also change the performance of the contacts. For example segment 1405 illustrated in FIG. 14 has transverse fingers 1455 that are tapered towards longitudinal rails 1450, 1460, whereas segment 1505 illustrated in FIG. 15 has transverse fingers 1555 that are tapered towards the center of the fingers. Each segment design may have particular benefits for a particular application and myriad designs can be used in further embodiments. Some embodiments, such as segment 1605 illustrated in FIG. 16, may only have one rail 1650. Thus the transverse fingers 1655 may only be attached to one rail and may be cantilevered. Further embodiments, such as illustrated in FIG. 17, may have segments 1705 with no rails or transverse fingers at all and may be dished, or deformed 1730 such that when plug 122 (see FIG. 1B) is inserted, the dished portion of the segment may deflect.

Figure 12:
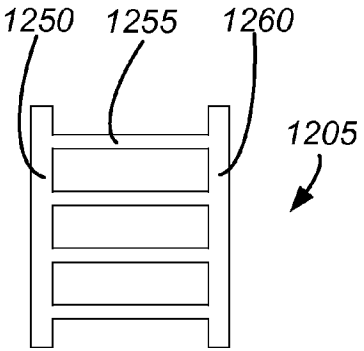
FIG. 12 is a diagram that illustrates a plan view of a contact segment in accordance with an embodiment of the invention.

Myriad contact designs may be employed in further embodiments. Any of the contact designs and segment designs discussed above may be employed as shown, or in other combinations. Further, different contact designs may be employed within a given connector. For example, a receptacle connector 200 may have one of contact 222*a*, one of contact 622*a*, one of contact 722*a* and one of contact 822*a*. Various combinations of contacts can be used in other embodiments. Additionally, different segment designs can be employed within a given receptacle connector 200. For example, a receptacle connector may have one of contact 222*a* with a segment design as illustrated in FIG. 12, and one of contact 622*a* with a segment design as illustrated in FIG. 14. Some embodiments may employ contacts that may have different normal forces. For example, some embodiments may place a contact with a higher normal force as the last contact to be engaged by plug 120 (see FIG. 1B), providing the user tactile feedback indicating full engagement of the plug.

Contacts may be made from any electrically conductive material, such as, for example, copper, brass, phosphor-bronze, steel or other materials. In some embodiments, contacts may also be plated with one or more metals. In one embodiment, each contact may be plated first with nickel, then with gold. Myriad methods can be used to manufacture the contacts. Housing 205, 210 (see FIG. 2) may be made from any non-electrically conductive material. In some embodiments the housing may be made from plastic and may be injection molded. In other embodiments the housing may be made from plastic and may be insert-molded. Myriad methods can be used to manufacture housing 205, 210 (see FIG. 2).

Figure 18:
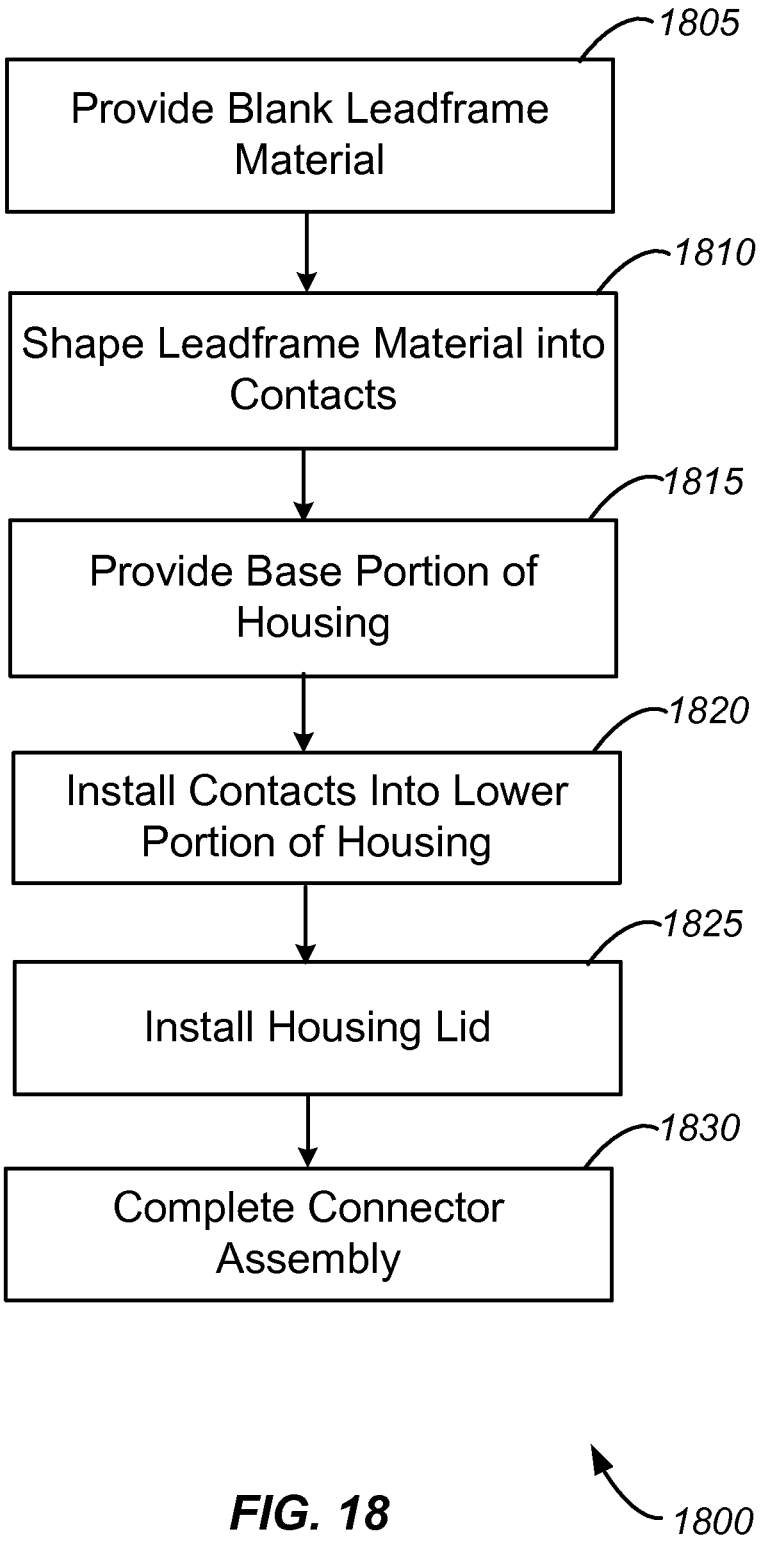
FIG. 18 is a process by which a connector with contacts comprising multiple points of contact can be made in accordance with an embodiment of the invention.

An exemplary simplified process 1800 for manufacturing a receptacle connector assembly with contacts comprising multiple points of contact, in accordance with embodiments described herein, is depicted in FIG. 18. In step 1805 a blank leadframe material may be provided. The leadframe material may comprise, for example, copper, brass, iron, phosphor-bronze, beryllium-copper, or other metallurgical alloys. In step 1810 the leadframe material may be shaped into contacts. The contacts can be made into myriad shapes without departing from the invention. In step 1815 a base portion of the plastic housing may be provided. In step 1820 the contacts may be installed in the lower housing. The contacts may have an inner portion disposed within the housing and an outer portion disposed outside of the housing. In step 1825 the housing lid may be installed. In step 1830 the receptacle connector may be completed, and is ready to be installed on a PCB.

Figure 19:
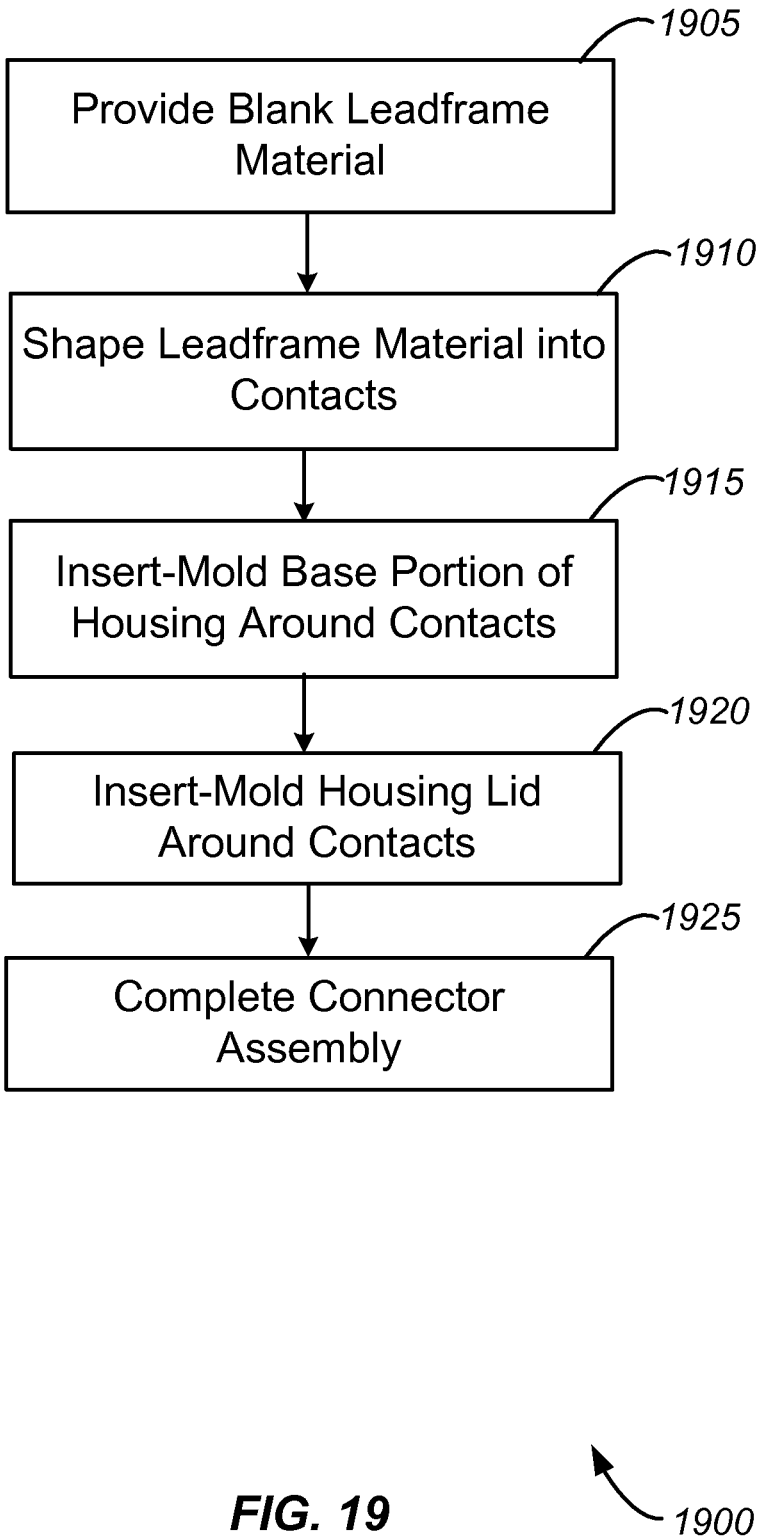
FIG. 19 is a process by which a connector with contacts comprising multiple points of contact can be made in accordance with an embodiment of the invention.

An alternative exemplary simplified process 1900 for manufacturing a receptacle connector assembly with contacts comprising multiple points of contact, in accordance with embodiments described herein, is depicted in FIG. 19. In step 1905 a blank leadframe material may be provided. The leadframe material may comprise, for example, copper, brass, iron, phosphor-bronze, beryllium-copper, or other metallurgical alloys. In step 1910 the leadframe material may be shaped into contacts. The contacts can be made into myriad shapes without departing from the invention. In step 1915 a base portion of the plastic housing may be insert-molded around the contacts. The contacts may have an inner portion disposed within the housing and an outer portion disposed outside of the housing. In step 1920 the housing lid may be insert-molded around the contacts. In alternative embodiments, the housing lid may be molded separately and subsequently mated with the base portion of the housing. In step 1925 the receptacle connector may be completed, and is ready to be installed on a PCB.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. An electrical audio receptacle connector comprising:

a receiving face with a front opening to receive a plug portion of a mating audio plug connector and a rear face disposed opposite of the receiving face;

a housing that extends between the receiving face and the rear face, the housing defining a cavity that communicates with the front opening; and a plurality of contacts, each of the plurality of contacts having an internal portion disposed within the cavity and an external portion disposed outside of the housing;

wherein the internal portion comprises a segment having a longitudinal rail and a plurality of transverse fingers attached to the longitudinal rail, the fingers arranged to contact a conductive portion of the plug portion of the mating audio plug; and wherein the housing has a base portion aligned with and mated to a lid portion along two or more interfaces that interlock along their entire length forming a liquid tight seal.

2. The electrical audio receptacle connector set forth in claim 1 wherein the internal portion of each of the plurality of contacts comprises a pair of parallel longitudinal rails; and wherein the plurality of transverse fingers are disposed between, and attached to the pair of parallel longitudinal rails.

3. The electrical audio receptacle connector set forth in claim 1 wherein the plurality of transverse fingers are substantially planar.

4. The electrical audio receptacle connector set forth in claim 1 wherein the plurality of transverse fingers are substantially arcuate.

5. The electrical audio receptacle connector set forth in claim 1 wherein the longitudinal rail is substantially straight.

6. The electrical audio receptacle connector set forth in claim 1 wherein the longitudinal rail is substantially circular.

7. The electrical audio receptacle connector set forth in claim 1 wherein the longitudinal rail is arcuate.

8. The electrical audio receptacle connector set forth in claim 1 wherein the internal portion comprises a first segment that is substantially straight and a second segment that is substantially straight and connected to the first segment at an angle of approximately 90 degrees.

9. The electrical audio receptacle connector set forth in claim 8 wherein the internal portion comprises a third segment that is substantially straight and is connected to the second segment at an angle of approximately 90 degrees.

10. The electrical audio receptacle connector set forth in claim 9 wherein the internal portion comprises a fourth segment that is substantially straight and is connected to the third segment at an angle of approximately 90 degrees;

wherein the four segments of the longitudinal rail form a substantially square internal portion.

11. The electrical audio receptacle connector set forth in claim 1 wherein the two or more interfaces are adhered to one another.

12. The electrical audio receptacle connector set forth in claim 11 wherein the lid portion comprises tabs along the interface and the base portion comprises tab receiving features along the interface.

13. An electrical audio receptacle connector comprising:

a receiving face with a front opening to receive a plug portion of a mating audio plug connector and a rear face disposed opposite of the receiving face;

a housing that extends between the receiving face and the rear face, the housing defining a cavity that communicates with the front opening;

wherein the housing has a base portion and a lid portion that are joined along an interlocking liquid tight interface; and a plurality of contacts, each of the plurality of contacts having a plurality of transverse fingers disposed within the cavity and arranged to contact a conductive portion of the plug portion of the mating audio plug.

14. The electrical audio receptacle connector set forth in claim 13 wherein the base portion has a slot disposed along the interface and the lid portion has a rail disposed along the interface; and wherein the rail is engaged in the slot along the interface.

15. An electrical audio receptacle connector for receiving an audio plug connector, the receptacle connector comprising:

a liquid tight body having an opening that communicates with a cavity having height, width and depth dimensions;

a plurality of contacts positioned within and spaced apart along the depth of the cavity, each of the plurality of contacts having four primary contact portions and a lead portion, the four primary contact portions including first and second opposing contact surfaces and third and fourth opposing contact surfaces that combine to form an aperture through which the audio plug connector can be inserted, the first and second opposing contact surfaces extending in the height dimension on opposite sides of the cavity and the third and fourth opposing contact surfaces extending in the width dimension on opposite sides of the cavity, and wherein the lead portion extends from one of the four primary contact portions out of the body through a liquid tight seal enabling the contact to be soldered to a substrate.

16. The electrical audio receptacle connector set forth in claim 15 wherein each of the plurality of contacts includes opposing rails and each primary contact portion includes one or more transverse fingers.

17. The electrical audio receptacle connector set forth in claim 16 wherein the transverse fingers are curved inward towards a line that longitudinally bisects a center of the cavity.

18. The electrical audio receptacle connector set forth in claim 15 wherein each primary contact portion includes at least three transverse fingers.

19. The electrical audio receptacle connector set forth in claim 15 wherein each of the plurality of contacts has four segments at 90 degree intervals and each segment has multiple individual contact points.

20. The electrical audio receptacle connector set forth in claim 15 wherein each of the plurality of contacts has a generally square cross-sectional shape.

21. The electrical audio receptacle connector set forth in claim 15 wherein each of the plurality of contacts has a generally circular cross-sectional shape.

22. The electrical audio receptacle connector set forth in claim 15 wherein the plurality of contacts consist of first, second, third and fourth contacts wherein the first contact conducts left audio signals, the second contact conducts right audio signals, the third contact conducts ground signals and the fourth contact conducts microphone signals.

23. An electrical audio receptacle connector for receiving an audio plug connector, the receptacle connector comprising:

a body having an opening that communicates with a cavity having height, width and depth dimensions, the body having a base portion and a lid portion that combine to form a liquid-tight tube like structure with the lid portion and the base portion joined along an interlocking interface that extends along at least one half of the depth of the body;

a plurality of contacts positioned within and spaced apart along the depth of the cavity, each contact having at least one contact surface configured to electrically couple to a contact of the audio plug connector during a mating event and a lead that extends out of the base portion of the body where the body forms a liquid-tight seal at an interface between each lead and the base portion of the body.

24. The electrical audio receptacle connector set forth in claim 23 wherein the lid portion is adhered to the base portion along the interface.

25. The electrical audio receptacle connector set forth in claim 23 wherein the lid portion and the base portion have interlocking geometry disposed along the entire interlocking interface.

26. The electrical audio receptacle connector set forth in claim 23 wherein each of the plurality of contacts includes opposing rails and each primary contact surface includes one or more transverse fingers.

27. The electrical audio receptacle connector set forth in claim 26 wherein each primary contact surface includes at least three transverse fingers.

28. The electrical audio receptacle connector set forth in claim 23 wherein each of the plurality of contacts has four segments at 90 degree intervals each of which has multiple individual contact points.

* * * * *